US011085323B2

(12) United States Patent
Harner et al.

(10) Patent No.: US 11,085,323 B2
(45) **Date of Patent: *Aug. 10, 2021**

(54) GAS TURBINE ENGINE SLOT TOOLS

(71) Applicant: United Technologies Corporation, Farmington, CT (US)

(72) Inventors: John Harner, Vernon, CT (US); Nathan C. Campagna, West Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 90 days.

This patent is subject to a terminal disclaimer.

(21) Appl. No.: 16/121,856

(22) Filed: Sep. 5, 2018

(65) Prior Publication Data

US 2020/0072077 A1 Mar. 5, 2020

(51) Int. Cl.
*F01D 25/00* (2006.01)
*B08B 1/00* (2006.01)
*B08B 7/04* (2006.01)

(52) U.S. Cl.
CPC ..... *F01D 25/002* (2013.01); *B08B 1/005* (2013.01); *B08B 1/008* (2013.01); *B08B 7/04* (2013.01)

(58) Field of Classification Search
CPC ..... F01D 25/002; A47K 11/10; A47K 7/028; A47L 25/00; A47L 13/44; A47L 13/46; A47L 13/022; B08B 1/005; B08B 7/00; B08B 1/008; B08B 7/04; B08B 1/00; B24D 15/00; B05C 17/00; A46B 7/04
See application file for complete search history.

(56) References Cited

U.S. PATENT DOCUMENTS 4,570,278 A * 2/1986 Bloome ..... A47L 11/185 15/230
7,412,741 B2 * 8/2008 Roney ..... F01D 25/002 134/6
7,997,386 B2 * 8/2011 Gillott ..... F01D 25/285 184/102
8,157,620 B2 * 4/2012 Corn ..... B24B 19/02 451/57
8,209,812 B1 * 7/2012 Dondurur ..... A46B 9/005 15/229.11
8,813,294 B2 * 8/2014 Frigo, Jr. ..... B32B 3/02 15/104.93
8,876,577 B2 * 11/2014 Lombard ..... B24B 7/188 15/52.1
10,385,724 B2 * 8/2019 Vogt ..... B24B 29/005
(Continued)

FOREIGN PATENT DOCUMENTS

FR 2886179 A1 12/2006
WO 2018219587 A1 12/2018

OTHER PUBLICATIONS

Partial European Search Report for European Application No. 19195566.5 dated Feb. 12, 2020.

*Primary Examiner* — Robert J Scruggs
(74) *Attorney, Agent, or Firm* — Carlson, Gaskey & Olds, P.C.

(57) ABSTRACT

A tool for a slot in a gas turbine engine, according to an example of the present disclosure, includes a head configured to be received in the slot, a first pad removably bonded to the head with an adhesive, and a second pad removably bonded to the head with an adhesive and disposed opposite from the first pad.

19 Claims, 9 Drawing Sheets

(56) References Cited

U.S. PATENT DOCUMENTS

| | | | | |
|---|---|---|---|---|
| 2011/0047732 | A1* | 3/2011 | Phillips | B25G 1/06 15/118 |
| 2011/0294407 | A1 | 12/2011 | Doyle et al. | |
| 2012/0005850 | A1 | 1/2012 | Frigo, Jr. | |
| 2013/0185877 | A1 | 7/2013 | Clark et al. | |
| 2013/0232715 | A1* | 9/2013 | Beaumont | A47L 13/18 15/246 |
| 2014/0150815 | A1* | 6/2014 | Chen | A46B 17/02 134/6 |
| 2016/0319696 | A1 | 11/2016 | Clark et al. | |

* cited by examiner

GAS TURBINE ENGINE SLOT TOOLS

BACKGROUND

This disclosure relates to a gas turbine engine, and more particularly to a tool for a slot in a gas turbine engine.

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

Various areas of a gas turbine engine including slots within engine hubs may accumulate grease and debris during operation. As an example, fan blades are received in slots in a rotor.

SUMMARY

A tool for a slot in a gas turbine engine, according to an example of the present disclosure, includes a head configured to be received in the slot, a first pad removably bonded to the head with an adhesive, and a second pad removably bonded to the head with an adhesive and disposed opposite from the first pad.

In a further embodiment according to any of the foregoing embodiments, the first pad provides a first curved outward facing surface, and the second pad provides a second curved outward facing surface.

In a further embodiment according to any of the foregoing embodiments, the first pad is cylindrical, and the second pad is cylindrical.

In a further embodiment according to any of the foregoing embodiments, the head includes a first rounded groove, the first pad is received in the first rounded groove, the head includes a second rounded groove, and the second pad is received in the second rounded groove.

In a further embodiment according to any of the foregoing embodiments, a handle extends from the head.

In a further embodiment according to any of the foregoing embodiments, the handle and the head is comprised of plastic, and the first pad is comprised of a second material different from plastic.

In a further embodiment according to any of the foregoing embodiments, the first pad and the second pad are elongated in a first direction and are disposed opposite the head from one another in a second direction substantially perpendicular to the first direction.

In a further embodiment according to any of the foregoing embodiments, the first pad and the second pad are formed of one of an abrasive, a rubber, and/or a sponge material, and the adhesive is comprised of one or more of acrylics, silicones, epoxies, urethanes, and imides.

In a further embodiment according to any of the foregoing embodiments, the adhesive is comprised of one or more of acrylics, silicones, epoxies, urethanes, and imides.

A method of finishing a slot in a gas turbine engine, according to an example of the present disclosure, includes inserting a tool into the slot. The tool includes a head configured to be received in the slot, a first pad removably bonded to the head with an adhesive, and a second pad removably bonded to the head with an adhesive and disposed opposite from the first pad. The first pad is moved along a channel at a first circumferential edge of the slot and the second pad is moved along a second channel at a second circumferential edge of the slot circumferentially opposite the first edge.

In a further embodiment according to any of the foregoing embodiments, the first pad provides a first curved outward facing surface, and the second pad provides a second curved outward facing surface, such that the tool is contoured to match the slot.

In a further embodiment according to any of the foregoing embodiments, a blade is removed from the slot before inserting a tool into the slot.

In a further embodiment according to any of the foregoing embodiments, debris and/or grease is removed from the first and second channels with the first and second cylindrical pads.

In a further embodiment according to any of the foregoing embodiments, the first and second channels are polished with the first and second cylindrical pads.

In a further embodiment according to any of the foregoing embodiments, one of the first and second cylindrical pads are removed from a location on the head. The removed pad is replaced with a third pad at the location, including removably bonding the third pad to the head with an adhesive, and repeating the method.

In a further embodiment according to any of the foregoing embodiments, the slot is eddy-current tested at an area where the pads had contacted the slot.

In a further embodiment according to any of the foregoing embodiments, the tool is moved along the slot in an axial direction relative to an engine central longitudinal axis.

A tool for a slot in a gas turbine engine, according to an example of the present disclosure, includes a head configured to be received in the slot, a first pad attached to the head to provide a first curved outer surface, and a second pad attached to the head to provide a first curved outer surface and disposed opposite from the first pad.

In a further embodiment according to any of the foregoing embodiments, the head provides a third curved outward facing surface that receives the first pad, and the head provides a fourth curved outward facing surface that receives the second pad.

In a further embodiment according to any of the foregoing embodiments, the first pad is cylindrical, and the second pad is cylindrical.

DETAILED DESCRIPTION

Figure 1:
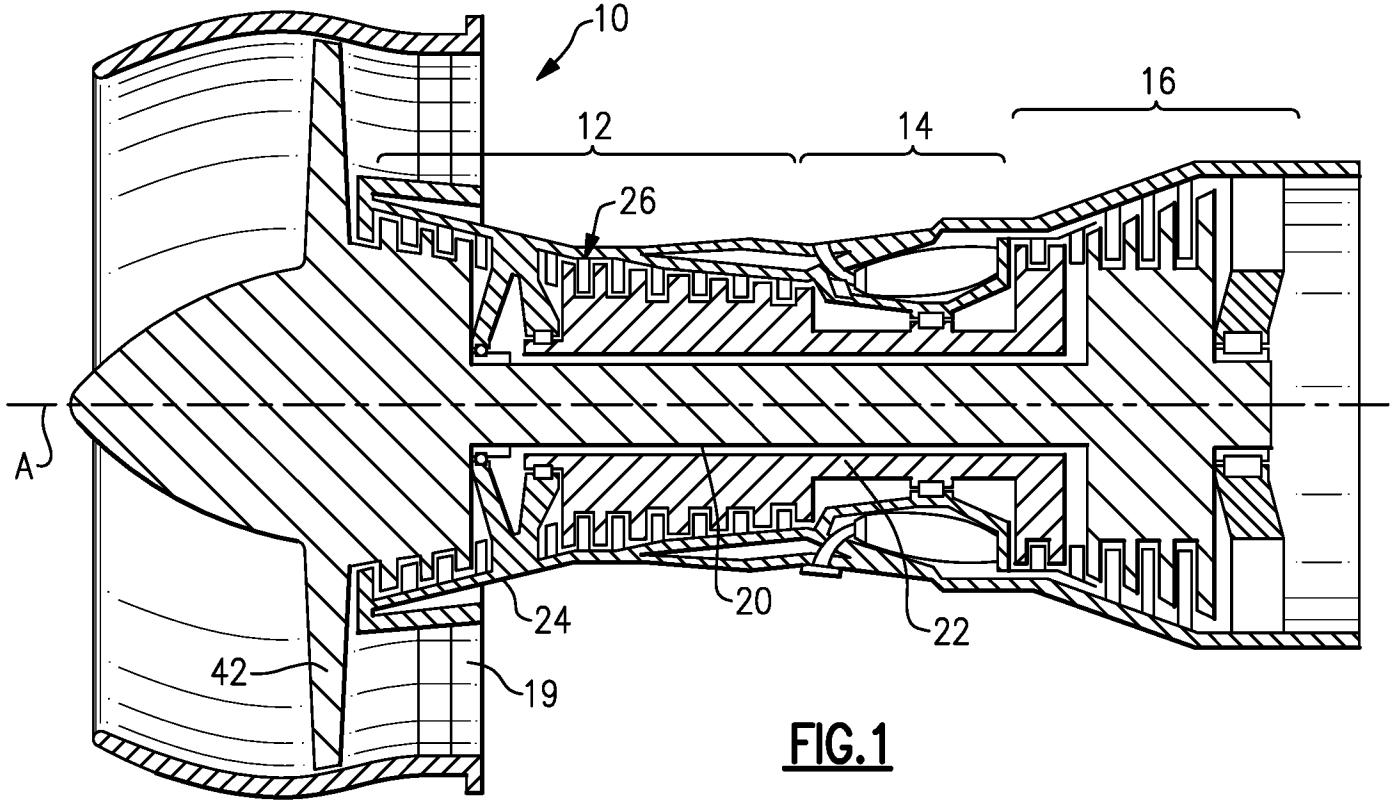
FIG. 1 schematically illustrates an example gas turbine engine.

An example gas turbine engine 10 is schematically illustrated in FIG. 1. The gas turbine engine 10 includes a compressor section 12, a combustor section 14 and a turbine section 16, which are arranged within a housing 24. In the example illustrated, high pressure stages of the compressor section 12 and the turbine section 16 are mounted on a first shaft 20, which is rotatable about an engine central longitudinal axis A. Low pressure stages of the compressor section 12 and turbine section 16 are mounted on a second shaft 22 which is coaxial with the first shaft 20 and rotatable about the axis A. In the example illustrated, the first shaft 20 rotationally drives a fan 42 that provides flow through a bypass flow path 19. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

Figure 2:
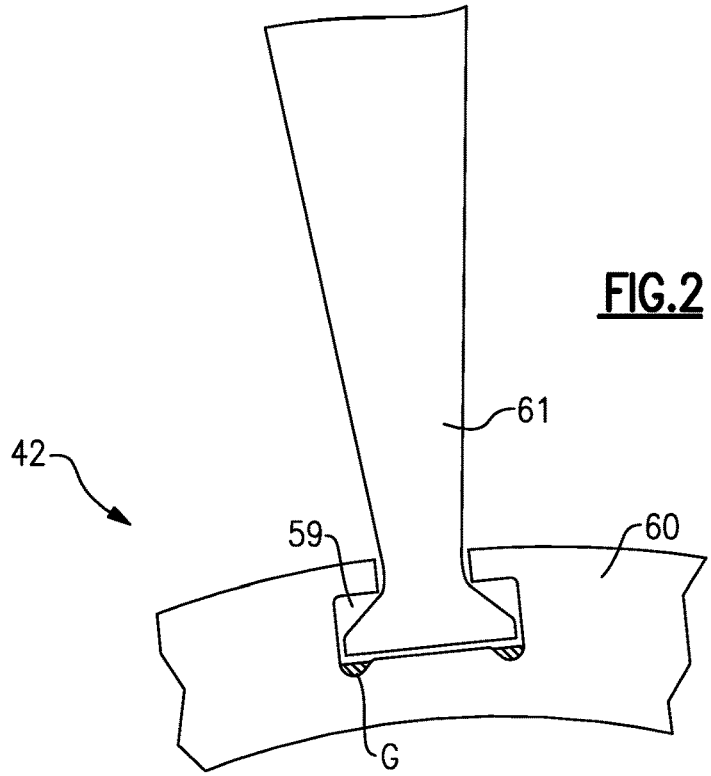
FIG. 2 illustrates a cross sectional view of a portion of a fan section of a gas turbine engine.

FIG. 2 illustrates a cross sectional view of a portion of the fan 42. Although one slot 59 and one blade 61 is shown in FIG. 2 for illustrative purposes, the fan 42 includes a number of slots 59 in a fan hub 60 receiving fan blades 61. As shown, the slot 59 may accumulate debris and/or grease G. Although a slot in a fan hub is disclosed in this example, other slots in gas turbine engines may benefit from this disclosure.

Figure 3:
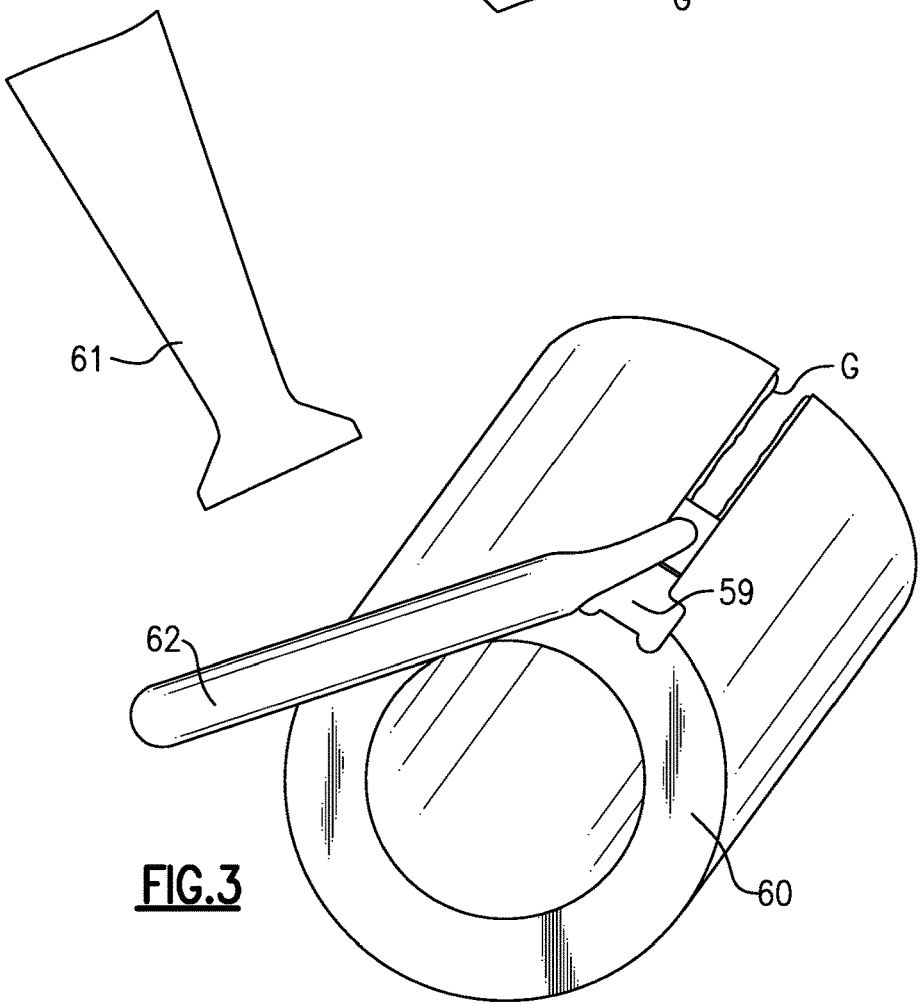
FIG. 3 illustrates an example tool for a slot in a gas turbine engine removing grease and/or debris from a slot.

FIG. 3 illustrates an example tool 62 received in the slot 59 for removal of grease and/or debris. In addition to or as an alternative to grease and/or debris removal, in some examples, the tool 62 may be used in other finishing operations, such as polishing (smoothing the surface of) the slot 59. That is, "finishing," as used in this disclosure, may include removal of grease and/or debris and polishing. In the illustrated example, the fan blade 61 is removed from the slot 59 before the tool 62 is received in the slot 59. Although one slot 59 is shown for illustrative purposes, the tool 62 may be used to finish multiple slots.

Figure 4:
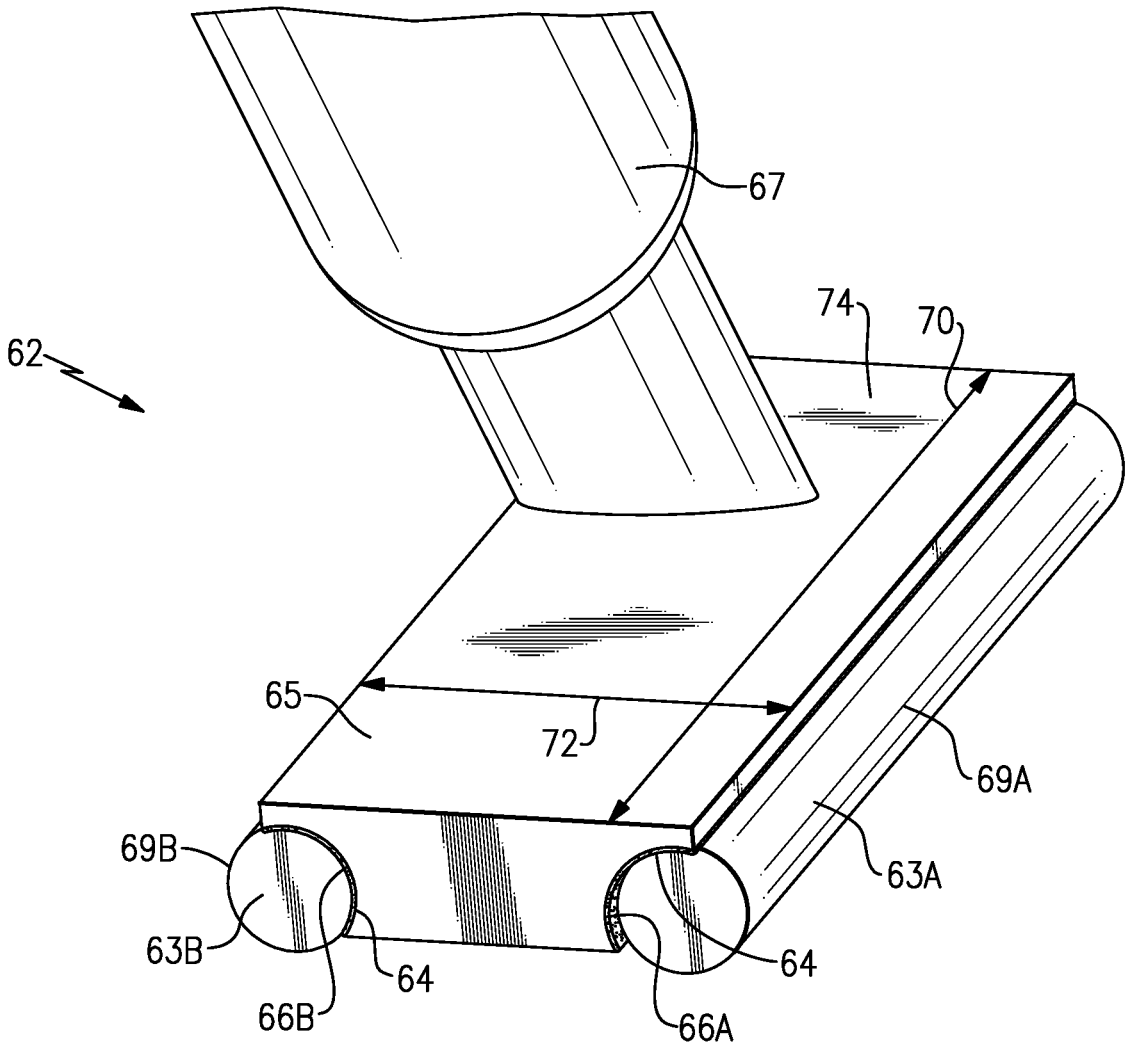
FIG. 4 illustrates the example tool of FIG. 3.

FIG. 4 illustrates an example tool 62 that may be used for finishing operations in the slot 59. The example tool 62 includes a head 65 and one or more pads 63A, 63B removably bonded to the head 65 with an adhesive 64. Example adhesives 64 may include acrylics, silicones, epoxies, urethanes, and/or imides. A handle 67 may extend from the head 65 for a user to engage to maneuver the tool 62 within a slot 59.

The head 65 includes a groove 66A to receive the pad 63A, which is in the shape of an elongated cylindrical rod and removably bonded to the groove 66A by an adhesive. As will be explained below, other shapes are contemplated within the scope of this disclosure. The groove 66A is rounded to accommodate the cylindrical shape of the pad 63A. The second pad 63B is substantially similar to the first pad 63A and removably bonded to a groove 66B by an adhesive opposite the head 65 from the pad 63A and groove 66A. The example pads 63A, 63B and their respective grooves 66A, 66B are each elongated in a first direction 70 and are opposite the head 65 from one another in a second direction 72 substantially perpendicular to the first direction 70. In the example, the grooves 66A, 66B are convex, and the pads 63A, 63B provide concave curved outward facing surfaces 69A, 69B. In some examples, the pads 63A, 63B may be made of abrasives, rubbers, or sponges. In some examples, the pads 63A, 63B are made of a silicone carbide filled rubber.

The handle 67 extends from an upper surface 74 of the head 65. In the example, the handle 67 and the head 65 are monolithic. In some examples, the handle 67 and the head 65 are formed by a 3D printing process, but other manufacturing processes are also contemplated. In some examples, the handle 67 and head 65 are formed of plastic material, which may include acrylics, epoxies, nylons, imides, polyethylenes, polypropylenes, styrenes, carbonates and/or polyesters. In some examples, the handle 67 and head 65 may be formed by filled plastics. Filler examples may include carbon, nanotubes, glass, and/or ceramic.

By removably bonding the pads 63A, 63B to the head 65 with an adhesive, the pads 63A, 63B are fixed to the head 65 strongly enough to perform finishing operations, while still being easily removed from the head 65 when replacement of the pads 63A, 63B is desired. That is, the adhesive provides a high enough shear strength for finishing operations to be performed and a low enough peel strength for removal of the pads 63A, 63B when replacement is desired.

Figure 5:
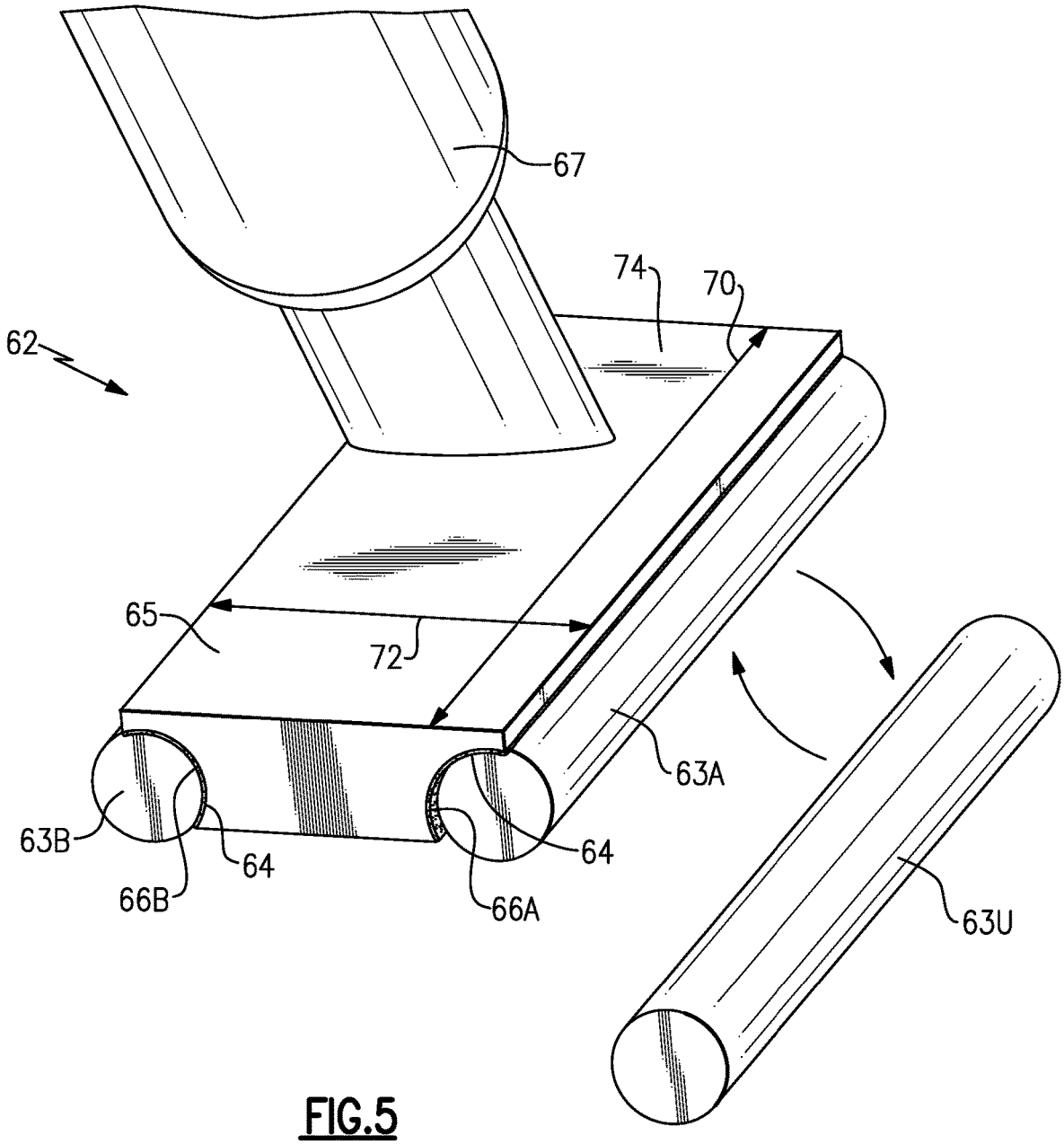
FIG. 5 schematically illustrates replacement of a pad in the example tool of FIGS. 3 and 4.

As shown schematically in FIG. 5, any one or both of the pads 63A, 63B may be replaced one or multiple times, with the head 65 and handle 67 being reused after pad replacement. As shown, a used pad 63U has been removed and replaced. Efficiency and cost savings is achieved by reuse of the head 65 and handle 67, which may be relatively expensive to manufacture. Moreover, by adhering the pads 63A, 63B to the head 65, the tool 62 may be assembled free of any fasteners, including metal fasteners, avoiding metal on metal contact with the slots 59.

Figure 6:
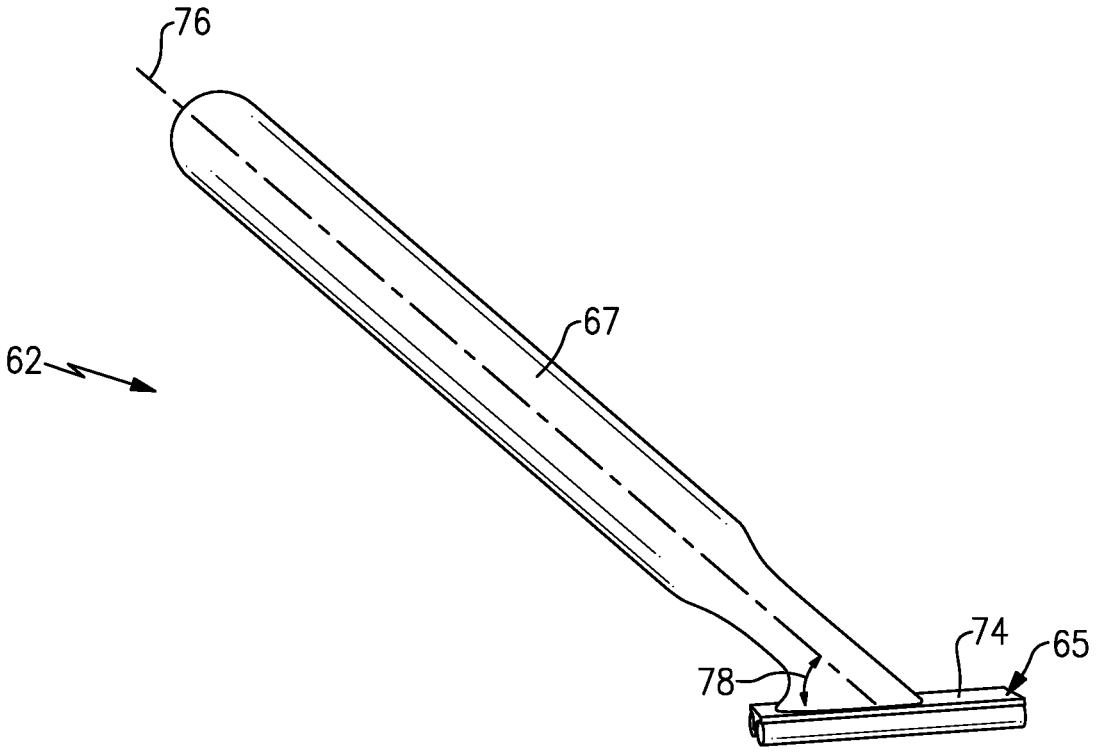
FIG. 6 illustrates a side view of the example tool of FIG. 3.

FIG. 6 illustrates a side view of the tool 62. The handle 67 extends from the upper surface 74 of the head 65 along a central axis 76 of the handle, which forms an angle 78 with the upper surface 74. In some examples, the angle 78 is less than 90 degrees. In other examples, the angle 78 is 90 degrees.

Figure 7A:
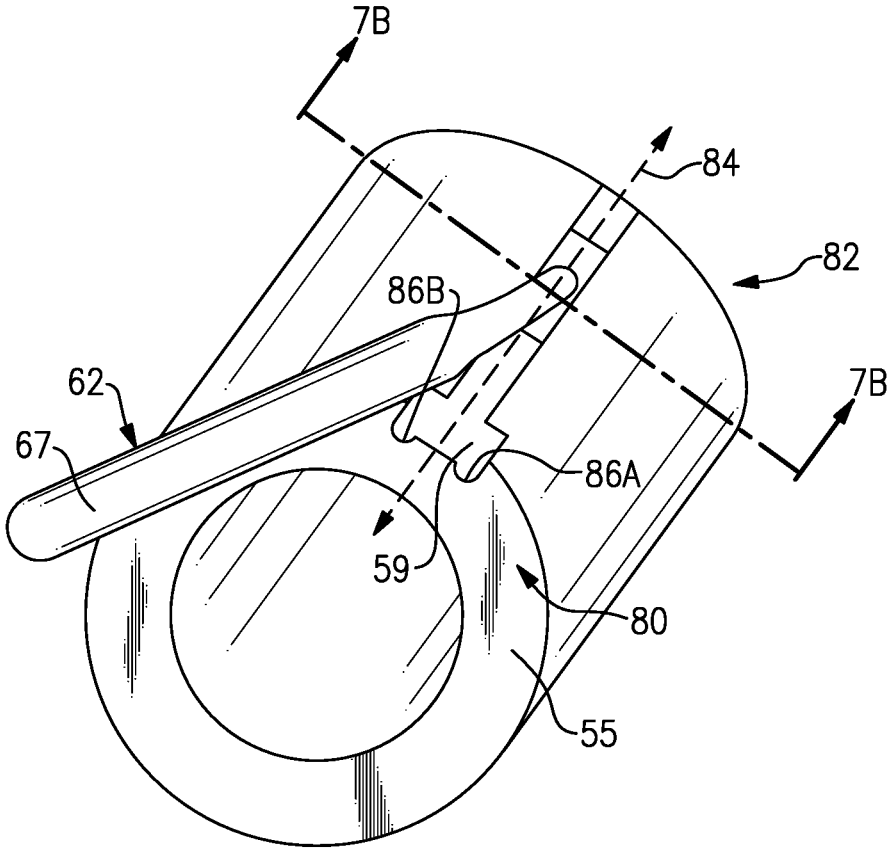
FIG. 7A illustrates the example tool of FIGS. 3-6 in a slot of a fan hub of a gas turbine engine.
Figure 7B:
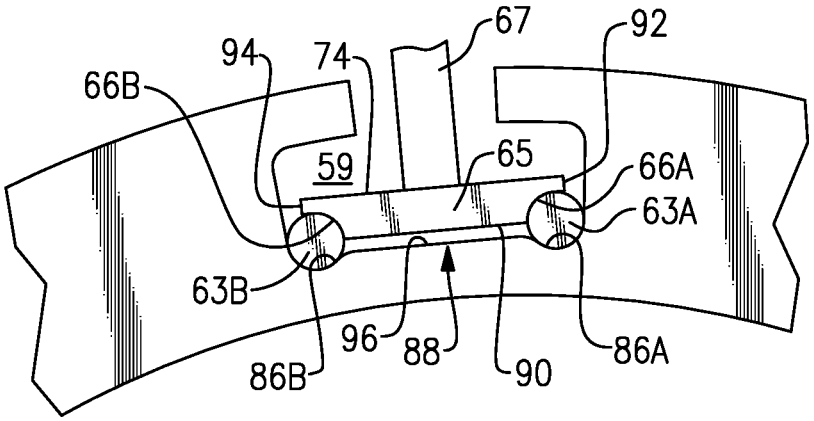
FIG. 7B illustrates a cross sectional view of the example tool of FIGS. 3-7A in a slot of a fan hub of a gas turbine engine.

FIGS. 7A and 7B illustrate the example tool 62 applied to a slot 59 in a fan hub 60 for finishing. As shown in FIG. 7A, the slot 59 extends axially from a first axial end 80 of the hub 60 to a second axial end 82 opposite the first axial end 80. The tool 62 may be inserted into the slot 59 at one of the axial ends 80, 82, and moved along the slot 59 in the direction 84 for finishing the slot 59. In the example, the direction 84 is substantially parallel to the engine central longitudinal axis (see FIG. 1). That is, the direction 84 may be in the forward and/or aft directions. The direction 84 is also substantially parallel to the direction 70 of elongation of the pads 63A, 63B (see FIG. 3). The tool 62 is configured to finish channels 86A, 86B at opposed circumferential edges of the slot 59 and extending axially along the length of the slot 59.

FIG. 7B shows a cross section of the head 65 and pads 63A, 63B within the slot 59. The pads 63A, 63B are received against the rounded channels 86A, 86B circumferentially opposite one another at the radially inner end 88 of the slot 59. The pads 63A, 63B are positioned to finish the respective channels 86A, 86B as the tool 62 moves along the slot 59. The friction of the pads 63A, 63B against the surface of the slot 59 at the channels 86A, 86B can polish and remove grease and/or debris. In some examples, other tools may be used to finish other areas of the slot 59.

The example head 65 includes the upper surface 74, the grooves 66A, 66B, a lower surface 90 is opposite the head 65 from the upper surface 74, and side surfaces 92 and 94. The lower surface 90 extends from the groove 66A to the groove 66B. The side surface 92 extends from the groove 66A to the upper surface 74. The side surface 94 opposite the head 65 from the side surface 92 extends from the groove 66B to the upper surface 74. In the example, the upper surface 74 and the lower surface 90 are substantially parallel.

A surface 96 of the slot 59 extends circumferentially from the channel 86A to the channel 86B and is elevated radially outward relative to the channels 86A, 86B. The lower surface 90 of the tool 62 is raised relative to the lowermost points of the pads 63A, 63B to provide a contour to match the slot 59. The portions of the head 65 that provide surfaces 92 and 94 are above the pads 63A, 63B when in use to allow a downward force to compress the pads 63A, 63B for finishing. In some examples, the tool 62 may be configured to finish the surface 96, such as by providing a pad at the surface 90 of the tool 62.

Figure 8:
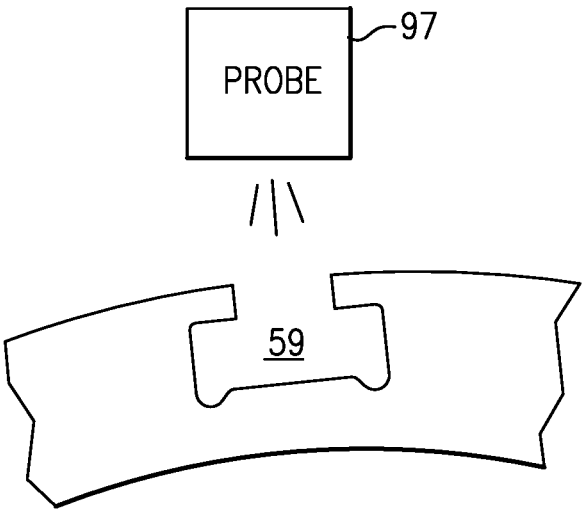
FIG. 8 schematically illustrates non-destructive testing performed on a slot in a gas turbine engine.

As shown schematically in FIG. 8, after the slot 59 is cleaned and/or polished, non-destructive inspection may be performed on the slot 59. As shown in the example, one example of non-destructive inspection is eddy current testing, a known method for testing for fatigue or cracks in metal in gas turbine engine components in which a probe 97 uses electromagnetic induction to detect flaws. The tool 62 (not shown) provides a smooth surface in and removes debris and/or grease from the slot 59 prior to eddy current testing. The smooth surface and lack of debris and/or grease provides for improved accuracy in the eddy current measurements. In some examples, the eddy current testing is performed on an area that was finished by the pads 63A, 63B, such as the channels 86A, 86B (FIGS. 7A & 7B).

Figure 9:
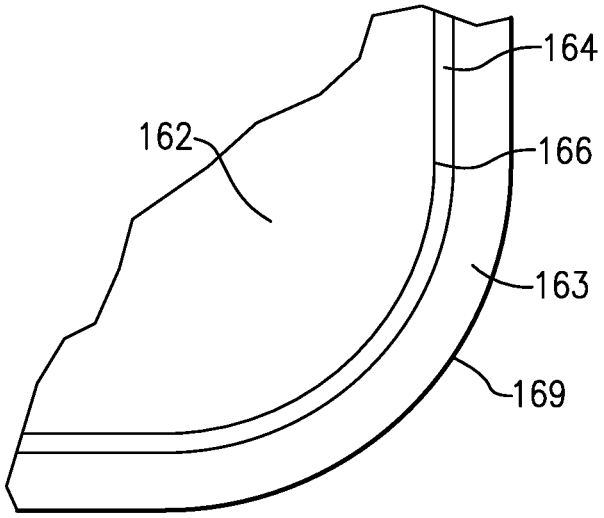
FIG. 9 illustrates a portion of another example tool.

FIG. 9 schematically illustrates a portion of another example tool 162. It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure. A substantially flat pad 163 may be removably bonded via an adhesive 164 to a convex curved surface 166 of the tool 162, such that the pad 163 provides a convex curved outward facing surface 169. One of ordinary skill in the art having the benefit of this disclosure would recognize that other geometries could be used to provide curved outward facing surfaces.

Figure 10:
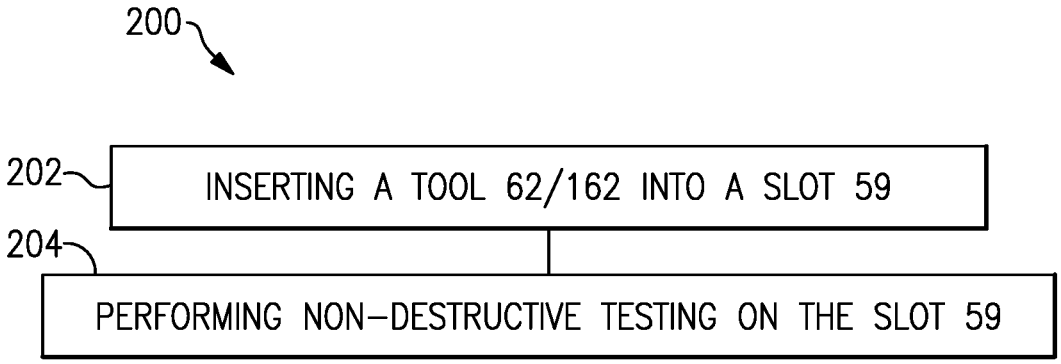
FIG. 10 illustrates a flow chart of a method of inspection of a gas turbine engine component.

FIG. 10 illustrates a flowchart of a method 200 of inspection of a gas turbine engine component. At 202, a tool 62/162 is applied to a slot 59. At 204, non-destructive inspection is performed on the slot 59.

Figure 11:
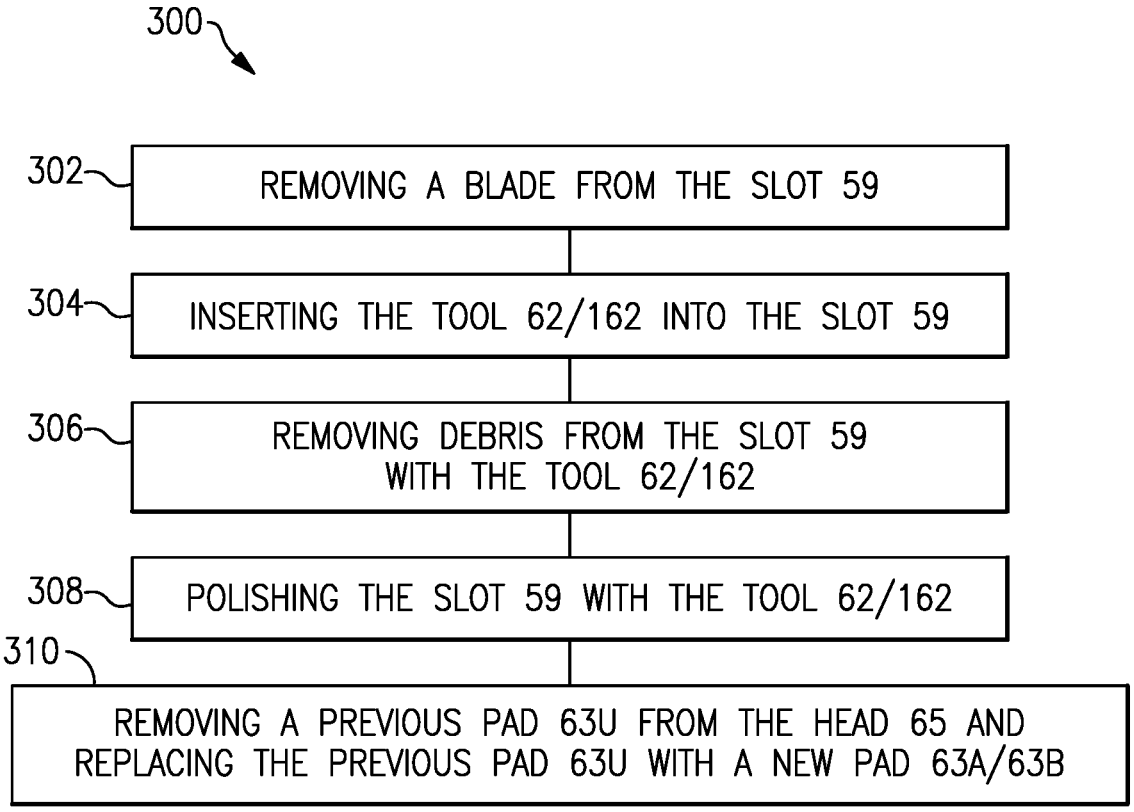
FIG. 11 illustrates a flow chart of a method of finishing a slot in a gas turbine engine.

FIG. 11 illustrates a flowchart of an example method 300 of finishing a slot 59 in a gas turbine engine. One or more of the steps may be performed, and the steps are not limited to the order shown. At 302, a blade may be removed from the slot 59. At 304, the tool 62/162 is inserted into to the slot 59. At 306, the method may include removing debris and/or grease from the slot 59 with the tool 62/162. At 308, the method may include polishing the slot 59 with the tool 62/162. At 310, the method may include removing a previous pad 63A, 63B from the head 65 and replacing the previous pad 63A, 63B with a new pad. Pads 63A, 63B may be replaced before or after the tool 62/162 is applied to a slot 59.

Figure 12:
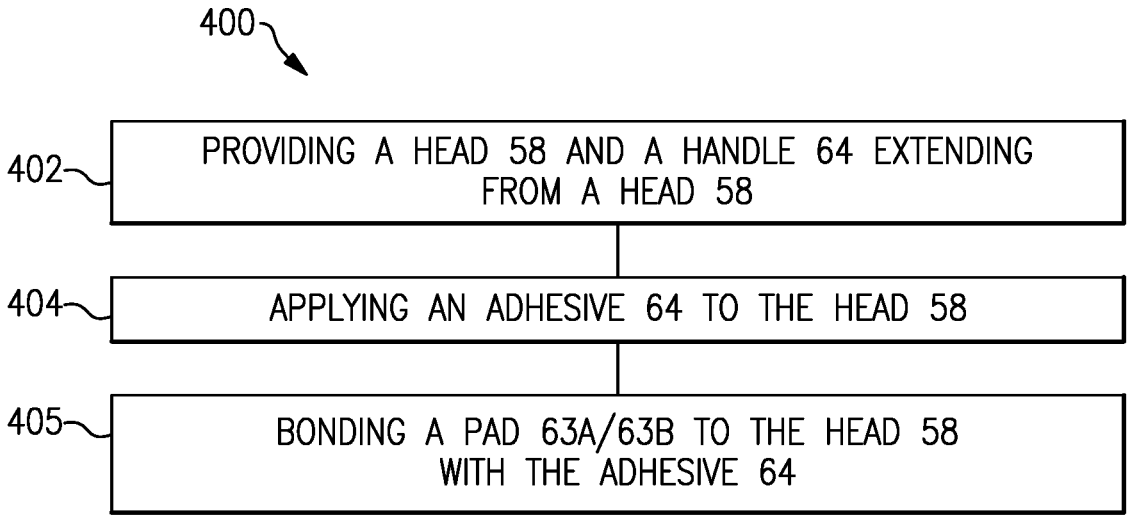
FIG. 12 illustrates a flow chart of a method of manufacturing a tool for finishing a slot in a gas turbine engine.

FIG. 12 illustrates a flowchart of a method 400 of manufacturing a tool for finishing a slot in a gas turbine engine. At 402, a head 65 and a handle 67 extending from the head 65 are provided. This step may include 3D printing the handle 67 and the head 65 in some examples. At 404, an adhesive is applied to the head 65. At 406, a pad 63A, 63B is bonded to the head 65 with the adhesive. In some examples, the method includes applying the adhesive to a groove in the head 65 and bonding the pad 63A, 63B to the groove. In some examples, the method includes mechanically affixing the pad to the head 65 while the adhesive cures and removing mechanical means after cure is complete.

Although the disclosed examples are directed to slots in fan hubs, other slots in gas turbine engines may benefit from this disclosure. Moreover, although specific geometries are disclosed in some examples, other geometries may be utilized to accommodate the slot to be finished.

Although embodiments have been disclosed, a worker of ordinary skill in this art would recognize that certain modifications would come within the scope of this disclosure. For that reason, the following claims should be studied to determine the true scope and content of this disclosure.

What is claimed is:

1. A tool for a slot in a gas turbine engine comprising:
a head configured to be completely received in the slot;
a handle directly extending from an upper surface of the head;
a first cylindrical pad having a circular cross section along its length and providing a first curved outward facing surface and removably bonded to the head with an adhesive; and
a second cylindrical pad having a circular cross section along its length and providing a second curved outward facing surface and removably bonded to the head with an adhesive and disposed opposite from the first pad, wherein a first extension portion defines a first side surface extending from a first groove to the upper surface, a second extension portion defines a second side surface extending from a second groove to the upper surface, and the first and second extension portions are configured to provide a downward force on the first and second pads as the head is moved within the slot in an axial direction relative to a centerline axis of the gas turbine engine.

2. The tool as recited in claim 1, wherein the first groove is a first rounded groove, the first pad is received in the first rounded groove, the second groove is a second rounded groove, and the second pad is received in the second rounded groove.

3. The tool as recited in claim 1, wherein the handle and the head comprise plastic, and the first pad comprises a second material different from plastic.

4. The tool as recited in claim 3, wherein the first pad and the second pad are elongated in a first direction and are disposed opposite the head from one another in a second direction substantially perpendicular to the first direction.

5. The tool as recited in claim 3, wherein the first pad and the second pad are formed of one of an abrasive, a rubber, and/or a sponge material, and the adhesive comprises one or more of acrylics, silicones, epoxies, urethanes, and imides.

6. The tool as recited in claim 1, wherein the adhesive comprises one or more of acrylics, silicones, epoxies, urethanes, and imides.

7. The tool as recited in claim 1, wherein the first cylindrical pad and second cylindrical pad are fixed against rotation when bonded to the head.

8. A method of finishing a slot in a gas turbine engine, comprising:

a) inserting a tool into the slot, wherein the slot is elongated in an axial direction with respect to an engine central longitudinal axis, and the tool includes a head configured to be received in the slot, a first pad removably bonded to the head with an adhesive, and a second pad removably bonded to the head with an adhesive and disposed opposite from the first pad; and b) moving the first pad along a channel at a first circumferential edge of the slot and moving the second pad along a second channel at a second circumferential edge of the slot circumferentially opposite the first edge, wherein the moving includes applying a downward force on the head, such that a first extension portion of the head above the first pad compresses the first pad and a second extension portion of the head above the second pad compresses the second pad, and moving the tool along the slot in the axial direction.

9. The method as recited in claim 8, wherein the first pad provides a first curved outward facing surface, and the second pad provides a second curved outward facing surface, such that the tool is contoured to match the slot.

10. The method as recited in claim 8, comprising:

removing a blade from the slot before step (a).

11. The method as recited in claim 8, comprising:

removing debris and/or grease from the first and second channels with the first and second pads.

12. The method as recited in claim 8, comprising:

polishing the first and second channels with the first and second pads.

13. The method as recited in claim 8, comprising:

removing one of the first and second pads from a location on the head;

replacing the one of the first and second pads with a third pad at the location, including removably bonding the third pad to the head with an adhesive; and repeating steps (a) and (b) in a second slot.

14. The method as recited in claim 8, comprising:

eddy current testing the slot, including at an area where the pads had contacted the slot.

15. A tool for a slot in a gas turbine engine comprising:

a head configured to be completely received in the slot and providing a first groove, a second groove, an upper surface, a lower surface opposite the upper surface and extending from the first groove to the second groove, a first extension portion providing a first side surface extending from the first groove to the upper surface, and a second extension portion providing a second side surface extending from the second groove to the upper surface;

a handle directly extending from the upper surface;

a first cylindrical pad having a circular cross section along its length and removably bonded to the head with an adhesive to provide a first curved outer surface; and a second cylindrical pad having a circular cross section along its length and removably bonded to the head with an adhesive to provide a first curved outer surface and disposed opposite from the first pad, wherein the lower surface is raised relative to a first lowermost point of the first pad and a second lowermost point of the second pad, wherein the first extension portion and the second extension portion are configured to be above the first pad and the second pad during use to provide a downward force on the first and the second pad as the head is moved within the slot in an axial direction relative to a centerline axis of the gas turbine engine.

16. The tool as recited in claim 15, wherein the first groove includes a third curved outward facing surface that receives the first pad, and the second groove includes a fourth curved outward facing surface that receives the second pad.

17. The tool as recited in claim 15, wherein the first pad and the second pad are elongated in a first direction and are disposed opposite the head from one another in a second direction substantially perpendicular to the first direction, the second direction provides a head width from the first side surface to the second side surface, and the first pad and the second pad, when bonded to the head, provide a tool width that is parallel with and greater than the head width.

18. The tool as recited in claim 17, wherein the lower surface extends from an elongated edge of the first groove to an elongated edge of the second groove, and the upper surface and the lower surface are not adjoining surfaces.

19. The tool as recited in claim 15, wherein the first cylindrical pad and second cylindrical pad are fixed against rotation when bonded to the head.

* * * * *